United States Patent [19]

Theurer et al.

[11] Patent Number: 4,986,189

[45] Date of Patent: Jan. 22, 1991

[54] MOBILE TRACK WORKING MACHINE

[75] Inventors: Josef Theurer, Vienna; Josef Göllner, Marchtrenk, both of Austria

[73] Assignee: Franz Plasser Bahnbaumaschinen-Industriegesellschaft m.b.H., Vienna, Austria

[21] Appl. No.: 430,631

[22] Filed: Nov. 1, 1989

[30] Foreign Application Priority Data

Jan. 26, 1989 [AT] Austria ..... 156/89

[51] Int. Cl.[5] ..... E01B 27/16

[52] U.S. Cl. ..... 104/12

[58] Field of Search ..... 104/17.2, 12, 17.1, 104/2, 7.1, 7.2, 10, 7.3

[56] References Cited

U.S. PATENT DOCUMENTS

| | | | |
|---|---|---|---|
| 3,762,333 | 10/1973 | Theurer et al. | 104/12 |
| 3,779,170 | 12/1973 | Plasser et al. | 104/12 |
| 4,094,250 | 6/1978 | Theurer | 104/12 |
| 4,537,135 | 8/1985 | Theurer | 104/12 |
| 4,596,193 | 6/1986 | Theurer | 104/12 |
| 4,627,358 | 12/1986 | Theurer | 104/12 |
| 4,632,037 | 12/1986 | Theurer et al. | 104/12 |
| 4,643,101 | 2/1987 | Theurer | 104/12 |
| 4,644,868 | 2/1987 | Theurer et al. | 104/12 |
| 4,760,797 | 8/1988 | Stubbs et al. | 104/12 |

OTHER PUBLICATIONS

*Internationales Verkehrswesen*, Nov./Dec., 1987, pp. 1–5, ("Conclusions for Mechanized Switch Work"), Erkenntnisse zue mechanisierten Weichendurcharbeitung.

*Primary Examiner*—Robert P. Olszewski
*Assistant Examiner*—Mark T. Le
*Attorney, Agent, or Firm*—Kurt Kelman

[57] ABSTRACT

A mobile track working machine comprises a machine frame, operating tools adjustably mounted on the machine frame, drives for adjusting the operating tools into various operating positions and into an inoperative position with respect to the track rails, controls for the drives for adjusting the operating tools into the various operating positions and into the inoperative position, and an apparatus for automatically controlling the positions of the operating tools. The apparatus includes sensors for monitoring the transverse position of the track rails and obstacles along the track, generators for output signals indicating respective ones of the monitored transverse position of the track rails and of obstacles along the track, and transmitters for transmitting the output signals to the drive controls whereby the operating tools are adjusted into the respective positions in response to the output signals.

17 Claims, 2 Drawing Sheets

MOBILE TRACK WORKING MACHINE

SUMMARY OF THE INVENTION (1) Field of the Invention

The present invention relates to a mobile machine for working on a track comprised of two rails fastened to ties, which comprises a machine frame, operating tools adjustably mounted on the machine frame, drives for adjusting the operating tools into various operating positions and into an inoperative position with respect to the track rails, means on the machine frame for controlling the drives for adjusting the operating tools into the various operating positions and into the inoperative position, and an apparatus for automatically controlling the positions of the operating tools. It more particularly relates to a track tamper comprising units of such operating tools arranged on the machine frame for intermittent advance along the track and hydraulic drives for vertically and preferably transversely adjusting the units, at least one of the units being a tamping head associated with a respective one of the track rails and the operating tools of the tamping head being pivotal tamping tools, and another one of the units being a track lifting and lining unit and the operating tools of the lifting and lining unit being vertically displaceable lifting and lining tools, the drives for the operating tools being hydraulically operated.

(2) Description of the Prior Art

Track leveling, lining and tamping machines of this type have been used to correct the position of tracks in the areas of switches and cross-overs, and to tamp the ballast of the corrected track to fix it in position. In view of- their intricate structure, track switches and cross-overs are subjected to more stress than tangent track, and because of their various structural components, such as guide rails, frogs and like "obstacles" encountered in switches, they are very difficult to grip for repositioning as well as to tamp. According to an article in "Internationales Verkehrswesen", Nov./Dec. 1987, pages 1–5, entitled "Erkenntnisse zur mechanisierten Weichendurcharbeitung" ("Conclusions for Mechanized Switch Work"), these problems have been solved by making each of the eight tamping tools per rail individually transversely displaceable. This makes it possible, as illustrated in FIG. 3 of the article, to tamp a switch at least with one tamping tool even in its most difficult locations where many "obstacles" are encountered. As shown in FIG. 7, the lifting and lining tools are also highly adaptable to use in such locations because the adjacent arrangement of an independently vertically and/or transversely adjustable lifting roller and lifting hook. These arrangements enable a continuous lifting and repositioning of very heavy switches and the continuous tamping of the repositioned switches.

A tamping unit for such a switch tamper has been disclosed in U.S. Pat. No. 4,537,135, dated Aug. 27, 1985. It requires a great number of operating controls for moving the many operating tools into inoperative positions when they encounter "obstacles" and, thus, great care and much experience by the operating personnel.

U.S. Pat. No. 3,762,333, dated Oct. 2, 1973, discloses a mobile track working machine capable of working at spaced locations along the track, particularly for tamping ballast under the ties of a track consisting of rails fastened to the ties. The required intermittent advance of the track tamper machine frame and the correspondingly intermittent lowering of the tamping heads in vertical alignment with each tie to be tamped are controlled by a distance measuring device or odometer comprising a distance measuring wheel carrying a signal pulse generator connected to a signal pulse counter. A pulsator or sensor is arranged ahead of the tamping heads in the operating direction of the machine on the underside of the machine frame for sensing a rail fastening element, such as a spike or bolt, therebelow when the advancing machine reaches the same and transmits a signal pulse to the counter which counts the pulses. When a pre-selected number of pulses has been counted, braking of the advancing machine is begun, when a second pre-selected number of pulses has been counted, the tamping heads are lowered, and after tamping has been completed, the counter is returned to its zero position. The machine is stopped each time with its tamping tools centered over the tie to be tamped, which enables tamping to proceed flawlessly, rapidly and automatically and to produce very high quality tamping of the ballast under the ties, even if the spacing between the ties is irregular. This production tamping machine with its automatic stopping at each tie to be tamped is well adapted for tangent track tamping and greatly facilitates the work of the operator. However, when the machine is used in a switch, stopping of the machine at each tie and centering of the tamping heads thereover must be effectuated manually to enable movement of the the operating tools to be so controlled that they avoid any "obstacles" in their way.

SUMMARY OF THE INVENTION

It is the primary object of this invention to provide a track working machine of the first-described type with controls enabling its operating tools to be rapidly and largely automatically adjusted to operation under even very difficult track conditions.

The above and other objects are accomplished in such a machine according to the invention with an apparatus for automatically controlling the positions of the operating tools, which includes means for monitoring the transverse position of the track rails and obstacles along the track, means for generating output signals indicating respective ones of the monitored transverse position of the track rails and of obstacles along the track, and means for transmitting the output signals to the drive controlling means whereby the operating tools are adjusted into the respective positions in response to the output signals.

A track working machine with such an apparatus makes it possible to take into consideration all "obstacles" encountered along the track and deviating from a normal track consisting of two rails fastened to ties and to control the adjustment of the tamping tools and/or of the lifting and lining tools in response to any encountered obstacle. Such operating tool adjustment controls very advantageously provide a flawless, rapid and largely automatic control of the many displacement and adjustment drives even in very difficult and complex track switch areas so that a very high and qualitatively uniform operating efficiency of the machine is assured. In addition, this automatic adjustment control of the operating tools prevents damage to the encountered "obstacles", resulting, for example, from an operating tool not fully pivoted or lifted out of the way of such an obstacle, without requiring the steady concentration of the operator which is almost impossible to achieve in view of the many operating tools which need to be differently adjusted at each tie of the switch. Furthermore, such a machine makes it possible to work on a complicated switch to the largest extent under the automatic controls of the operating tool drives so that the operating tools will be in their desired operative or inoperative positions, depending on the obstacles encountered, so that the switch will be tamped and, if required, repositioned accurately, rapidly and with the highest quality.

BRIEF DESCRIPTION OF THE DRAWING

The above and other objects, features and advantages of the present invention will become more apparent from the following detailed description of a now preferred embodiment thereof, taken in conjunction with the accompanying, somewhat schematic drawing wherein.

DETAILED DESCRIPTION OF PREFERRED EMBODIMENT

Figures 1, 2:
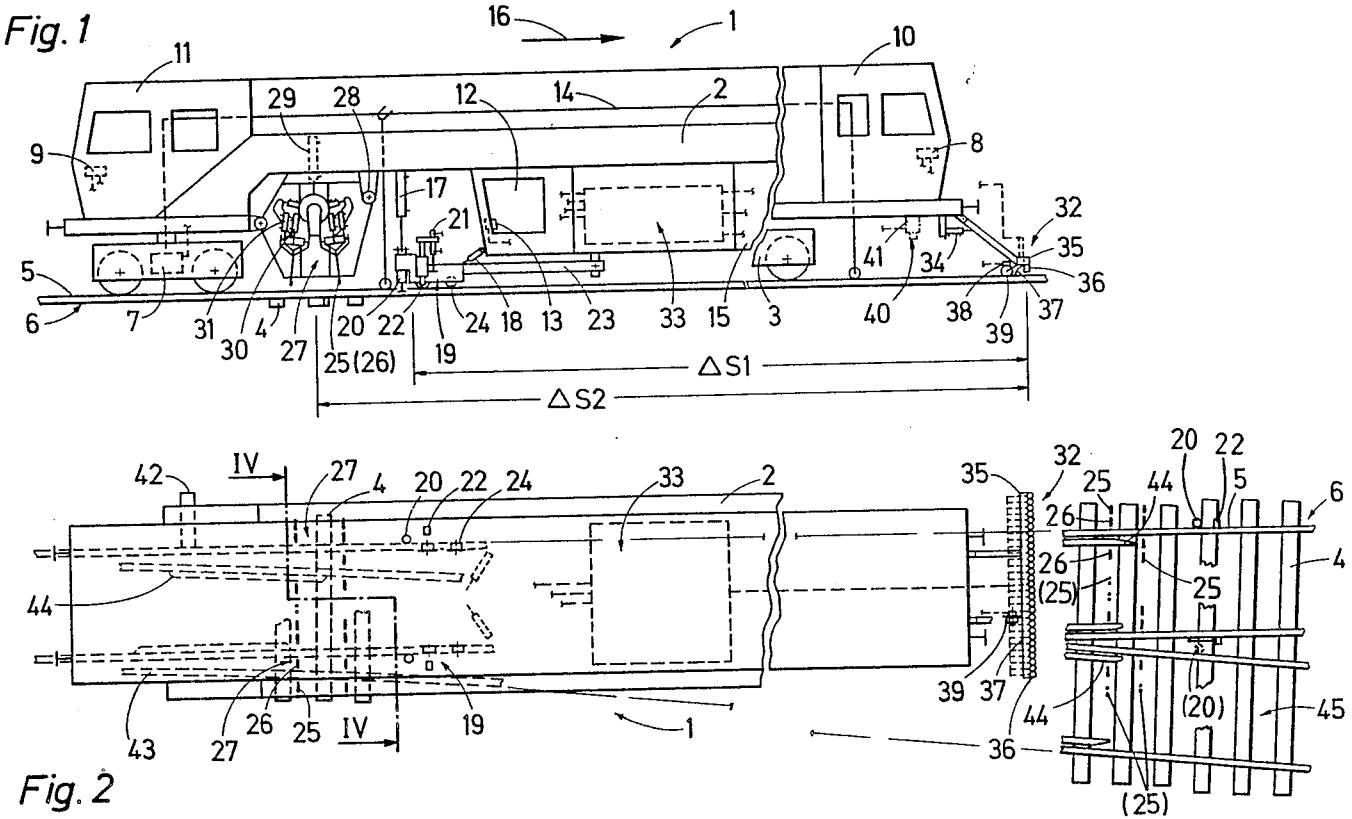
FIG. 1 is a side elevational view of a track working machine, i.e. a switch tamper, with an apparatus for automatically controlling the positions of the operating tools according to this invention and a central control.
FIG. 2 is a top view of the machine, with the positions of the operating tools shown diagrammatically.

FIGS. 1 and 2 illustrate a switch leveling, lining and tamping machine 1, briefly referred to throughout the specification as switch tamper, which comprises elongated machine frame 2 mounted on swivel trucks 3 for mobility along track 6 consisting of rails 5 fastened to ties 4. Drive 7 propels the machine along the track in an operating direction indicated by arrow 16. Respective driver's cab 10, 11, each equipped with drive control panel 8, 9, respectively, is mounted at each end of machine frame 2, and operator's cab 12 equipped with control unit 13 is arranged on the underside of the machine frame between the ends thereof. Leveling and lining reference system 14 is supported on the track rails by rail position sensing rollers to sense any track position errors and to generate corresponding track position error signals for control of the track lining and/or lifting tools in a conventional manner. All the drives on track working machine 1 are hydraulically operated from power plant 15 equipped with a drive motor and hydraulic fluid pumps feeding hydraulic fluid to the drives.

Illustrated switch tamper 1 comprises track lifting and lining unit 19 arranged immediately rearwardly of operator's cab 12 in the operating direction and vertically adjustable hydraulic lifting drives 17 and transversely adjustable hydraulic lining drives 18 link unit 19 to the machine frame. The operating tools of track lifting and lining unit 19 include a lifting roller 20 per rail, which is vertically displaceable by pivoting into and out of engagement with the field side of the associated rail, a lifting hook 22 per rail, which is vertically displaceable by hydraulic drive 21 for selectively gripping the foot or the head of the associated rail, and flanged lining wheels 24 which support machine frame 23 of lifting and lining unit 19 on rails 5 of track 6. Machine frame 23 has a forwardly projecting center pole whose free end is universally linked to machine frame 2 and whose rear end is supported on the track by flanged wheels 24. Lifting and lining drives 17, 18 link the rear machine frame end to machine frame 2 for vertical and transverse displacement of the lining wheels. A respective tamping head 27 of the general type disclosed in U.S. Pat. No. 4,537,135 is associated with each track rail 5 immediately behind lifting and lining unit 19 in the operating direction, and the operating tools of each tamping head are pivotal vibratory tamping tools 25, 26 arranged in pairs and reciprocal in the operating direction. The tamping heads are transversely displaceably mounted on guide beam 28 affixed to machine frame 2 and extending transversely to the track. Hydraulic drive 29 is linked to each tamping head for vertically displacing the same. Each of the tamping tools 25, 26 has its own independently operable drive 30, 31 for pivoting the tools selectively into operating and inoperative positions in a direction extending transversely to the track rails, i.e. in the longitudinal extension of the ties.

The illustrated track working machine comprises an apparatus for automatically controlling the positions of operating tools 20, 22, 24 and 25, 26, with central control circuit means 33 including electro-hydraulic control circuit 50 for controlling the hydraulic drives for adjusting the operating tools as well as for vertically and/or transversely displacing units 19 and 27 into various operating positions and into inoperative positions. This apparatus includes means 32 for monitoring the transverse position of track rails 5 and of obstacles along the track, such as switch links 42, frogs 43, guide rails 44 and the like. Illustrated means 32 is comprised of measuring beam 35 extending transversely of track 6 and having a length corresponding at least to that of ties 4. Drive 34 links the measuring beam to the front end of machine frame 2 for vertically adjusting the measuring beam, and a plurality of sensors 36, 37 are arranged adjacently along the length of measuring beam 35 for monitoring the transverse position of the track rails. Another sensor constituted by television camera 41 monitors obstacles along the track, and the sensors generate output signals indicating respective monitored transverse positions of the track rails and an image of any monitored obstacle along the track. The output signals are transmitted to drive controlling means 50 whereby the operating tools are adjusted into the respective positions in response to the output signals. Electro-hydraulic control circuit 50 has inputs receiving the respective output signals and outputs connected to the hydraulic drives for independently controlling each drive in response to the received output signals. This arrangement has the advantage that, in response to any sensed obstacle, the drive of an operating tool in the range of this obstacle will be immediately and dependably adjusted into its inoperative position and returned to its operating position as soon as the obstacle has been passed.

Measuring beam 35 precedes tamping heads 27 and track lifting and lining unit 19 in the operating direction of the machine, as indicated by arrow 16, at a predetermined distance therefrom and carries distance measuring or odometer wheel 39 rolling on track rail 5, and its signal transmitter 38 transmits an output signal indicating the traveled distance of the machine along the track to electro-hydraulic control circuit 50. Drive 34 links measuring beam 35 to machine frame 2 for vertically adjusting the measuring beam. This arrangement of the vertically adjustable position monitoring sensors enables the apparatus to be retrofitted to an existing machine and, in addition, is not affected by the lifting of the track by unit 19. The closely adjacent arrangement of the sensors along the entire track bed width will enable the apparatus to monitor all encountered obstacles that may interfere with the operation of the operating tools and to locate the same accurately, the number of activated sensors and the duration of their activation indicating the dimensions of the monitored obstacle. The transmission of the output signals from the sensors to drive controlling control circuit 50 is delayed by the output signal from odometer transmitter 38 in dependence on the distance of the measuring beam from the tamping heads and track lifting and lining unit. This predetermined spacing of measuring beam 35, with its odometer, from the operating tools of the machine positively eliminates any interference with the operation, the output signals from the odometer indicating the traveled distance from the monitored obstacle to the operating tools. The delayed transmission of the output signal from the obstacle sensor to the drive control will cause the corresponding drives to be actuated only when the respective operating tool is exactly in registry with the obstacle, at which point it will be driven into its inoperative position.

As is shown diagrammatically in FIG. 2, two tamping tools 25, 26 are arranged on each side of the associated rail and of the associated tie. Depending on the location of obstacles 42, 43, 44, they are independently adjustable into various operating positions and into an inoperative position by drives 30, 31. For a better understanding, tamping tools 25 laterally pivoted into inoperative positions are shown by a pair of dots while tamping tools 25, 26, which are in their operating positions, are shown in full lines. The two lifting rollers 20 associated with a respective track rail 5 are shown in their operating positions, in which they grip the rail, while preceding lifting hook 22 has been transversely and vertically adjusted into its inoperative position, i.e. disengaged and remote from the associated rail. As the top view of FIG. 2 shows, a multiplicity of sensors 36, 37 are adjacently arranged along the entire length of measuring beam 35 over the width of the track bed. Immediately ahead of machine 1, in the operating direction, track 6 forms switch 45. All the sensors 36, 37, 40 as well as odometer signal transmitter 38 are connected to control circuit 33 and this circuit is connected to the drives of the operating tools to be adjusted in response to encountered obstacles.

Figures 3, 4, 5, 6, 7:
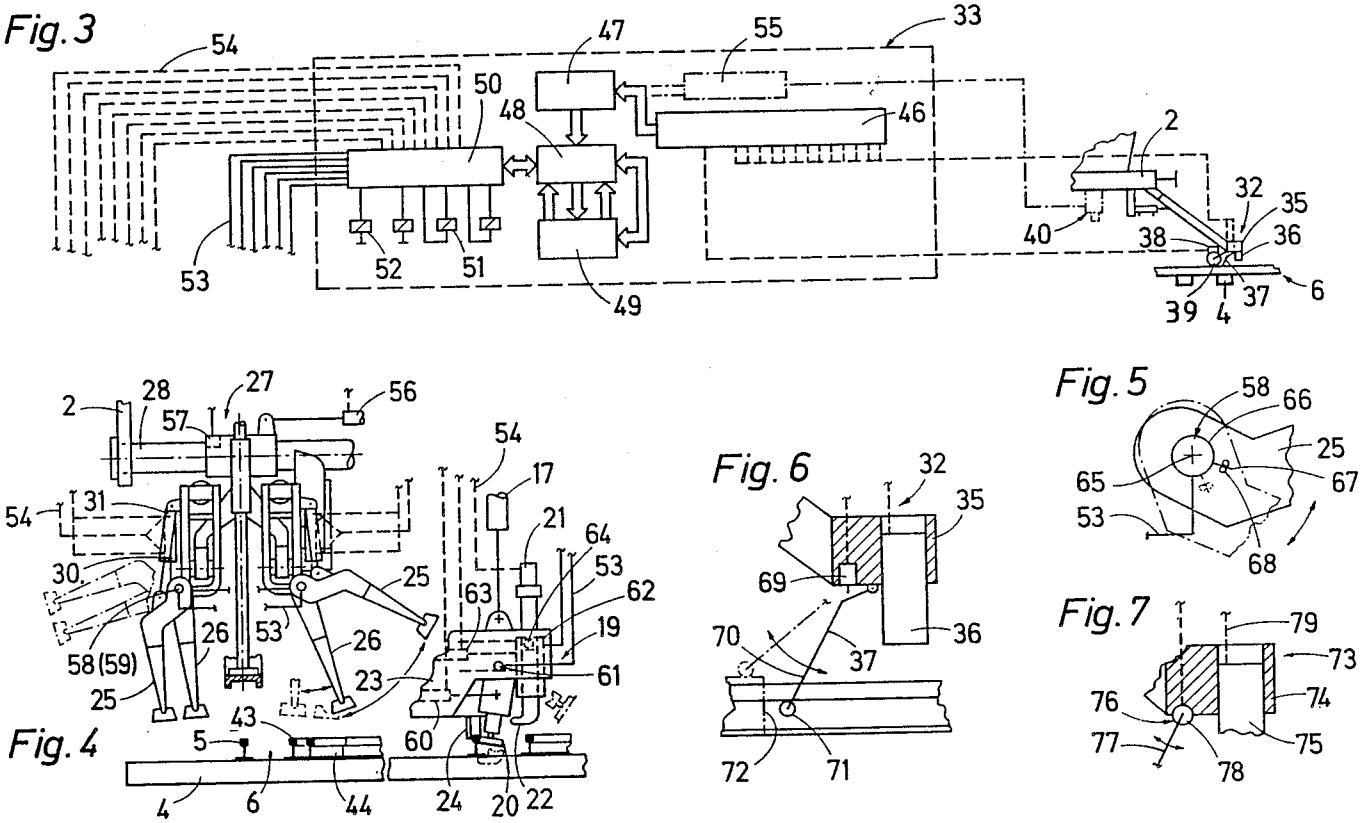
FIG. 3 is an enlarged circuit diagram schematically showing the central control connected by signal transmission lines to the means for monitoring the transverse position of the track rails and of obstacles along the track as well as to the drives for the operating tools.
FIG. 4 is an enlarged end view of the switch tamping unit and the track lifting and lining unit, along line IV—IV of FIG. 2.
FIG. 5 is an enlarged, fragmentary side view of one of the tamping tools shown in FIG. 4, with an actual position signal transmitter indicating the actual position of the tool.
FIG. 6 is an enlarged, fragmentary cross sectional view of the means for monitoring the transverse position of the track rails and of obstacles along the track.
FIG. 7 is a like view showing a modification thereof.

Central drive control 33 is illustrated in FIG. 3. It comprises signal processing circuit 46 having inputs arranged to receive the output signals of sensors 36, 37 and of measuring wheel 39 and outputs for transmitting the processed received signals. It further comprises intermediate memory 47 operating as a delay circuit having inputs connected to the signal processing circuit outputs and outputs for transmitting the delayed signals, and computer 48 having inputs connected to the outputs of delay circuit 47 and outputs connected to the inputs of electro-hydraulic control circuit 50. Computer 48 comprises memory 49 for storing the signals transmitted to the control circuit. The signals processed in circuit 46 are stored in intermediate memory 47 until tamping tools 25, 26 and/or lifting tools 20, 22 have reached an obstacle 42, 43, 44 or a rail monitored by one of the sensors as machine 1 advances along track switch 45 a distance corresponding to distance $\Delta S1$ or $\Delta S2$ between monitoring and signal generating means 32 and operating tools 20, 22 or 25, 26. Computer 48, which receives the delayed control signals, computes the desired positioning of the operating tools on the basis of the received control signals and transmits corresponding signals to drive control circuit 50. Memory 49 adapts the computer to receiving additional operating tool adjustment and positioning data, such as data stored therein during preceding work on a switch. Image-processing circuit 55, which is capable of recognizing designs of obstacles viewed by television camera 40, is connected between the television camera and intermediate memory 47. This circuitry enables the signals to be flawlessly and dependably processed in conformity with the spacing of the respective operating tools from the monitoring and signal generating means so that control circuit 50 will automatically drive the operating tools into their desired positions. The computerized control will not only assure a fully automatic operation but enables control signals indicating an obstacle in the way of any operating tool to be stored so that the operating tools will be driven into their inoperative positions at the exact moment they reach the previously monitored obstacle. Using a television camera with an image-processing circuit enables obstacles to be monitored optically-electronically without physical contact with the obstacle so that metallic a well as non-metallic track obstacles may be sensed.

As also shown in the preferred embodiment of central control 33, proportional or servo valves 51 connect the outputs of electro-hydraulic control circuit 50 to the hydraulic drives for adjusting the positions of operating tools 20, 22, 25, 26 if continuous adjustment and positioning of the tools is required, or simple hydraulic valves 52 are used for this purpose if a switch-over from one to another operating tool is desired, for instance between lifting roller 20 and lifting hook 22, or if, for example, tamping tools 25, 26 are to be adjusted into their inoperative positions when they encounter, say, obstacle 42 shown in FIG. 2. If the drives for the transverse displacement of lifting and lining unit 19 are connected to electro-hydraulic control circuit 50 by proportional or servo valves and the drives for transversely pivoting the tamping tools and the lifting tools into their inoperative positions are connected to the outputs of circuit 50 by hydraulic valves, the lifting and lining unit will be displaced in proportion to the corresponding location of the monitored obstacle and the operating tools will be rapidly adjusted between their operating and inoperative positions.

Drive control circuit 50 receives control signals computed by computer 48 to correspond to the desired positions of the operating tools as well as signals indicating the actual position of the tools through signal transmission lines 53. The outputs of electro-hydraulic control circuit 50 are connected by signal transmission lines 54 (shown in broken lines in FIG. 3) to the respective drives described in more detail hereinafter in connection with FIG. 4.

As shown in FIG. 4, each tamping head 27 has four like pairs of tamping tools 25, 26 for arrangement along the field and gage sides of an associated rail as well as the longitudinal edges of the ties, the tamping tools being independently transversely adjustable. (For a clearer showing, only the two pairs of tamping tools along one longitudinal tie edge are illustrated while the two pairs of tools along the opposite longitudinal tie edge have not been shown.) The two tamping tools 25, 26 at the field side of rail 5 are shown in their normal operating positions while tamping tool 25 at the gage side of the rail has been slightly pivoted transversely into another operating position and tamping tool 26 at the gage side has been pivoted into an inoperative position (see arcuate arrows). Transverse displacement drive 56 connects tamping head 27 to machine frame 2 for displacing the tamping head along transverse guide beam 28 supporting the tamping head on the machine frame. An actual position signal transmitter 57 indicates the transverse position of the tamping head with respect to track 6 and machine frame 2. In addition, an actual position indicating signal transmitter 58, 59 indicates the actual pivoting position of each tamping tool 25, 26. Hydraulic drive 60 connects lifting roller 20 to carrier frame 23 of lifting and lining unit 19 and the lifting roller is mounted on the carrier frame for pivoting about an axis extending in the longitudinal direction of track 6 so that drive 60 may adjust the lifting roller transversely between an operating position (shown in full lines), wherein the lifting roller engages the head of the rail, and an inoperative position (shown in phantom lines). Actual position indicating signal transmitter 61, for example a rotary potentiometer, indicates the actual pivoting position of lifting roller 20. Lifting hook 22 is vertically adjustably mounted on carrier frame 23 in guide block 62 wherein it may be vertically adjusted by drive 21, and the guide block is transversely displaceable along a guide track by drive 63. Actual position indicating signal transmitter 64 indicates the actual position of the lifting hook. The actual position indicating signal transmitters 57, 58, 59, 61 and 64 are connected by transmission lines 53 to the inputs of electro-hydraulic control circuit 50 for transmitting the actual position indicating signals thereto. These signals may also selectively be fed to computer 48. In this way, the actual position of the operating tools as well as units 19 and 27 may be readily determined so that the required adjustment with respect to this actual position may be controlled by the sensors.

As shown in FIG. 5, actual position indicating signal transmitter 58 is arranged in alignment with pivoting axis 65 of tamping tool 25 and is constituted by rotary potentiometer 66 whose resistance is variable by means of laterally projecting adjustment lever 67. The lever is clamped between two stops 68 affixed to the tamping tool so that a transverse pivoting adjustment of the tamping tool by hydraulic drive 31 (FIG. 4) about pivoting axis 65 extending in the direction of the longitudinal extension of machine frame 2 produces a corresponding adjustment of lever 67 between the positions shown in full and phantom lines, respectively, and a change in the resistance of rotary potentiometer 66 resulting therefrom. The potentiometer generates an output signal corresponding to the variable resistance and this is transmitted to control circuit 50 to feed the actual position of the tamping tool thereto.

The sensors on measuring beam 35 may be constituted by inductive, capacitative or opto-electronic proximity switches or as ultrasonic transducers, for example, and each sensor is connected by a signal transmition line to signal processing circuit 46. With such sensors, it is possible to monitor metallic obstacles without direct contact and, if they comprise limit button switches operated by leaf springs with sprain gages or rotary potentiometers operated by leaf springs or rods, they may in a simple manner monitor non-metallic obstacles. An array of closely adjacent sensors along the entire width of the track bed will dependably monitor all obstacles, such as frogs or guide rails, deviating from the tangent track comprised of two parallel rails fastened to ties and at least partially also from the branch track at the switch, and will also locate such monitored obstacles with respect to their distance from the center of the track.

As shown in FIG. 6, a limit sensing switch 69 with leaf spring 70 vertically movably mounted on measuring beam 35 is associated with sensor 36 constituted as a proximity switch mounted on measuring beam 35. A free end of leaf spring 70 engages a track rail and carries a friction-reducing roller 71 running along the track rail. The leaf spring forms a sensor 37 capable of monitoring non-metallic obstacles 72 along the track, which will cause leaf spring 70 to be raised into a position shown in phantom lines to actuate limit switch 69. After the obstacle has been passed, the leaf spring will return to its original position shown in full lines.

FIG. 7 illustrates a modification showing monitoring and signal generating means 73 for monitoring obstacles along the track and comprising transversely extending measuring beam 74 carrying a plurality of adjacently arranged sensors 75 constituted by inductive, capacitative or opto-electronic proximity switches 75 for monitoring metallic obstacles. A like number of sensors 76 for monitoring non-metallic obstacles is mounted on the measuring beam immediately behind sensors 75. Sensors 76 are comprised of downwardly projecting leaf spring 77 affixed to rotary potentiometer 78 for varying the resistance thereof. Each sensor 75, 76 has its own transmission line 79 transmitting an output signal of the sensor to the signal processing circuit of central control 33. Using a rotary potentiometer for sensor 76 has the advantage that the sensor cannot only detect non-metallic obstacles but can also monitor their height, the resistance of the rotary potentiometer varying with the height of the obstacle contacted by leaf spring 77.

The operation of the illustrated machine will now be described in detail in connection with a switch position correction:

Switch tamper 1 advances intermittently from tie to tie while the track is raised to its desired level by track lifting and lining unit 19, with lifting rollers 20 and/or lifting hooks 22 in engagement with their associated track rails 5, and each tie is tamped by tamping heads 27. Apparatus 32 is lowered by drive 34 to monitor obstacles 42, 43, 44, 72 encountered along the track as machine 1 advances, with odometer wheel 39 running along track rail 5. For a better understanding, we shall describe the situation when sensors 36 are in exact vertical alignment with tie 4 centered below tamping head 27 shown in FIGS. 1 and 2. As can be seen in FIG. 2, two obstacles in the shape of frog 43 and guide rail 44 are encountered at this location. These metallic obstacles will activate, for example, the 10th and 11th sensor 37, generating a corresponding "monitored obstacle" signal which, in connection with the pulse from distance measuring signal transmitter 38, is transmitted to control circuit means 33. These signals are stored in intermediate memory 47 while machine 1 and apparatus 32 have traveled distance ΔS1 from track lifting tools 20, 22 and distance ΔS2 from tamping head 27. As soon as a number of pulses corresponding to this distance has been transmitted by signal transmitter 38, the "monitored obstacle" signals stored in memory 47 will be transmitted to computer 48 and electro-hydraulic control circuit 50. Computer 48 is so programmed that, for example, signals from the 10th and 11th sensors 36 will operate drives 30, 31 of the two gage side tamping tools 25, 26 (see FIG. 4) of the left tamping head 27 until tamping tool 26 has been pivoted through an arc of about 18° into another operating position while tamping tool 25 has been pivoted into an inoperative position. This positioning of the tamping tools makes it possible that tie 4 is tamped by at least one tamping tool even at this very difficult track location at which obstacles 43 and 44 are present. The opposite pair of tamping tools 25, 26 at the field side of track rail 5 remains in the normal operating position since no obstacle in their path has been monitored. As soon as the signals for operating drives 30, 31 have been transmitted through respective lines 54 to pivot tamping tools 26, 25, actual position indicating signal transmitters 59 and 58 will transmit a respective signal back to control circuit 50 through lines 53 to indicate the pivoted positions of the tamping tool.

For tamping the ties in the branch track of switch 45, tamping head 27 must be transversely displaced by operation of transverse displacement drive 56. The extent of this transverse displacement is also monitored by sensors 36, 37 and, after the machine has traveled distance ΔS2, drive 56 is operated until actual position indicating signal transmitter 57 indicates the desired position of the tamping head as it is centered over branch rail 43. After tie 4 has been tamped and tamping head 27 has been raised, machine 1 is moved forward again to the next tie while tamping tools 25, 26 are suitably repositioned and the tamping head is transversely displaced under the control of apparatus 32 which monitors the transverse positions of the track rails and obstacles along the track. The same controls are effective for the tamping head associated with the opposite track rail.

Simultaneously and during the same operation, lifting rollers 20 and lifting hooks 22 of track lifting and lining unit 19 may be repositioned in response to any encountered obstacle monitored by apparatus 32, the signals being stored in memory 47 a shorter time because of shorter distance ΔS1 between the track lifting tools and measuring beam 35. Where no obstacles are encountered, it is desirable to engage the lifting rollers and the lifting hook with their associated rail. But if an obstacle makes engagement of lifting hook 22 with the rail impossible, as shown in FIG. 4, drives 21 and 63 will be actuated to raise the lifting hook into an inoperative position and to displace it transversely to an outer end position. A signal corresponding to the actual lifting hook position is then transmitted back to control circuit 50 by transmitter 64. Since the encountered obstacle does not prevent engagement of lifting roller 20 with the rail, drive 60 is actuated to pivot the roller into tight engagement therewith, causing the rail to be gripped firmly between flanged rollers 24 and lifting roller 20 so that track 6 can be leveled and lined. Particularly in the initial section of switch 45, lifting roller 20 may be pivoted into varying operating positions for engagement with switch rail 43, this positioning of th lifting roller being under the control of sensors 36, 37 and determined by the signal from actual position indicating signal transmitter 61 which indicates the desired pivoted position of the lifting roller.

Sensors 37 are designed for monitoring non-metallic obstacles 72 and operate parallel to sensors 36 and in the same manner.

As the diagrammatic showing of switch 45 in FIG. 2 indicates, each operating tool 20, 22, 25, 26 may be individually and independently driven to bring them into positions dictated by the track configuration. The tamping tools (25), shown in dotted lines, are pivoted up into their inoperative positions while adjacent tamping tools 26 are pivoted just a little towards the center of the track to avoid guide rail 44. Lifting roller (20) has been pivoted up into its inoperative position while adjacent lifting hook 22 operates as the sole lifting tool until the signals from apparatus 32 drive the lifting roller and tamping tool (25) back into their operating positions.

In addition to sensors 36, 37, television camera 41 and its image-processing circuit 55 may be used for monitoring obstacles. Electro-hydraulic control circuit 50 has proportional or servo valves 51 controlling the drives for operating tools 20, 22, 25, 26 if a continuous control and positioning of the tools is required or simple hydraulic valves 52 if it is only desired to switch between an operative and an inoperative position, i.e. to use either lifting tool 20 or 22, or to pivot the tamping tools from the lowermost operating position to the uppermost inoperative position.

In addition to this control of the positions of the operating tools in response to monitored positions of the rails and/or to obstacles, it is also possible to store control data corresponding to predetermined switch configurations in the control circuit, including the following possibilities:

(1) The positioning and displacement data for operating tools 20, 22, 25, 26 and for tamping head 27, which were obtained during work on a like switch 45, are stored in memory 49 and can be used again when correction work is done later on the same switch or a switch of the same configuration. Such an apparatus for automatically controlling the positions of the operating tools of a track working machine preferably is capable of receiving and storing all tool adjustment and positioning data required for working the entire track switch or similar track section. This has the advantage that the stored data may be used in later work for a most efficient operation of the machine in the same or a like track section.

(2) The data obtained during switch correction work under manual operating tool control are obtained by the actual position indicating signal transmitters and these data are stored for use in later work. Such a machine enables a correction operation subsequent to the manually controlled operation to be effectuated efficiently by the automatic control derived from the first operation.

(3) The data of the desired geometry of the switch and of the obstacles in this track area are fed into computer 48, are read by a data carrier, and the required positioning control of the operating tools is calculated on the basis of these data to provide the required control signals. This arrangement enables switches of different configurations to be simply and efficiently worked with an automatic control of the operating tool drives in response to the calculated control signals.

Computer 48 preferably has means for feeding external data thereto, i.e. a floppy disc or the like, and an input connection for a monitor for indicating obstacles. It may also be desirable to provide the computer with a keyboard to enable an operator to put in data and correction values. Also, while the invention has been illustrated and described in connection with a switch tamper, it may be used for automatically controlling the positioning of operating tools of other track working machines.

What is claimed is:

1. A mobile machine for working on a track comprised of two rails fastened to ties, which comprises (a) a machine frame, (b) operating tools adjustably mounted on the machine frame, (c) drives for adjusting the operating tools into various operating positions and into an inoperative position with respect to the track rails, (d) means on the machine frame for controlling the drives for adjusting the operating tools into the various operating positions and into the inoperative position, and (e) an apparatus for automatically controlling the position of the operating tools, the apparatus including (1) means for monitoring the transverse position of the track rails and obstacles along the track, and for generating output signals indicating respective ones of the monitored transverse position of the track rails and of obstacles along the track, the monitoring means comprising a measuring beam extending transversely of the track and having a length corresponding at least to that of the ties and a plurality of sensors arranged adjacently along the length of the measuring beam for monitoring the transverse position of the track rails, and (2) means for transmitting the output signals to the drive controlling means whereby the operating tools are adjusted into the respective position in response to the output signals.

2. The track working machine of claim 1, wherein the means for monitoring the transverse position of the track rails and of obstacles along the track comprises a drive for vertically adjusting the measuring beam.

3. The track working machine of claim 1, wherein the measuring beam is arranged forwardly of the machine frame in an operating direction of the machine.

4. The track working machine of claim 1, wherein the monitoring and signal generating means comprises a further sensor constituted by a television camera for monitoring obstacles along the track and for transmitting an image of any monitored obstacle to the drive controlling means, and further comprising an image-processing circuit connected between the television camera and the drive controlling means.

5. The track working machine of claim 1, wherein at least some of the sensors are proximity switches.

6. The track working machine of claim 1, wherein at least some of the sensors are ultrasonic transducers.

7. The track working machine of claim 1, wherein at least some of the sensors comprise a limit switch and a leaf spring vertically adjustably mounted on the measuring beam for vertical displacement by an obstacle monitored thereby, the vertical displacement of the leaf spring operating the limit switch.

8. The track working machine of claim 1, wherein at least some of the sensors comprise a rotary potentiometer and a leaf spring vertically adjustably mounted on the potentiometer for vertical displacement by an obstacle monitored thereby, the vertical displacement of the leaf spring rotating the potentiometer.

9. The mobile track working machine of claim 1, comprising units of said operating tools arranged on the machine frame for intermittent advance along the track and hydraulic drives for vertically adjusting the units, at least one of the units being a tamping head associated with a respective one of the track rails and the operating tools of the tamping head being pivotal tamping tools, and another one of the units being a track lifting and lining unit and the operating tools of the lifting and lining unit being vertically displaceable lifting and lining tools, the drives for the operating tools being hydraulically operated.

10. The track working machine of claim 9, further comprising hydraulic drives for transversely adjusting the units whereby the machine is adapted to operate as a switch leveling, lining and tamping machine, the means for controlling the hydraulic drives for adjusting the operating tools into the various operating positions and into the inoperative position comprising an electro-hydraulic control circuit having inputs receiving the respective output signals and outputs connected to the hydraulic drives for independently controlling each drive in response to the received output signals, and the monitoring and signal generating means comprising at least one sensor arranged for monitoring a respective one of the track rails and any obstacle along th track.

11. The track working machine of claim 10, further comprising proportional or servo valves connecting the outputs of the electro-hydraulic control circuit to the hydraulic drives for adjusting the positions of the operating tools.

12. The track working machine of claim 10, further comprising hydraulic valves connecting the electro-hydraulic control circuit outputs to the hydraulic drives for adjusting the positions of the operating tools.

13. The track working machine of claim 10, wherein the monitoring and signal generating means precedes the tamping heads and the lifting and lining unit in an operating direction of the machine at a predetermined distance therefrom and comprises a distance measuring wheel transmitting an output signal indicating the traveled distance of the machine along the track to the electro-hydraulic control circuit, the transmission of the output signals to the drive controlling control circuit being delayed by the output signal from the distance measuring wheel in dependence on the distance of the monitoring and signal generating means from the tamping heads and track lifting and lining unit.

14. The track working machine of claim 13, further comprising a signal processing circuit having inputs arranged to receive the output signals of the sensors and the measuring wheel and outputs for transmitting the processed received signals, an intermediate memory operating as a delay circuit having inputs connected to the signal processing circuit outputs and outputs for transmitting the delayed signals, and a computer having inputs connected to the outputs of the delay circuit and outputs connected to the inputs of the electro-hydraulic control circuit.

15. The track working machine of claim 14, wherein the compufer comprises a memory for storing the signals transmitted to the control circuit.

16. The track working machine of claim 14, further comprising an actual position indicating signal transmitter associated with each hydraulic drive for respectively indicating the positions of the units and of the operating tools, each transmitter generating an output signal indicating the actual position of a respective one of the units and operating tools, and means for transmitting the actual position indicating signals selectively to the computer or to the electro-hydraulic control circuit.

17. The track working machine of claim 16, wherein the actual position indicating signal transmitters are rotary potentiometers including a sensing rod at the rotary axis of the potentiometer.

* * * * *